United States Patent [19]

Bierlein et al.

[11] Patent Number: 4,964,168

[45] Date of Patent: Oct. 16, 1990

[54] CIRCUIT FOR STORING A SPEECH SIGNAL IN A DIGITAL SPEECH MEMORY

[75] Inventors: Günter Bierlein, Schwabach; Helmut Salbaum, Röttenbach, both of Fed. Rep. of Germany

[73] Assignee: U.S. Philips Corp., New York, N.Y.

[21] Appl. No.: 321,610

[22] Filed: Mar. 10, 1989

[30] Foreign Application Priority Data

Mar. 12, 1988 [DE] Fed. Rep. of Germany ..... 3808298

[51] Int. Cl.[5] ..... G10L 7/02

[52] U.S. Cl. ..... 381/36

[58] Field of Search ..... 381/29–41, 381/51–53; 364/513.5; 375/122, 25–31; 341/126, 141, 143, 144, 155

[56] References Cited

U.S. PATENT DOCUMENTS

| | | | |
|---|---|---|---|
| 4,318,188 | 3/1982 | Hoffmann | 381/51 |
| 4,330,689 | 5/1982 | Kang et al. | 381/36 |
| 4,622,680 | 11/1986 | Zinser | 381/29 |
| 4,718,087 | 1/1988 | Papamichalis | 381/34 |

*Primary Examiner*—Gary V. Harkcom

*Assistant Examiner*—John Merecki

*Attorney, Agent, or Firm*—Emmanuel J. Lobato

[57] ABSTRACT

A circuit arrangement for storing a speech signal in a digital speech memory (SP) and reproducing the stored signal comprises among other things a control circuit (SS). The control circuit produces control commands and clock signals for the individual modules of the arrangement. The speech signal to be stored is available in one of various predetermined codes. In order to enable storing speech signals of considerable lengths, it is provided to write the speech signal into the digital speech memory (SS) in a preferred digital code. For this purpose, input converters (EW1, EW2, EW3, EW4) are used which convert the code of the speech signal to be stored from the one it has into the preferred digital code, if the signal is not already available in this code. Multiplexing means (M1, M2), controlled by the control circuit (SS), further convey the converted speech signal to the input of the digital speech memory (SP). Output converters (AW1, AW2, AW3, AW4) convert the speech signal read from the digital speech memory (SP) into each of the predetermined codes.

7 Claims, 1 Drawing Sheet

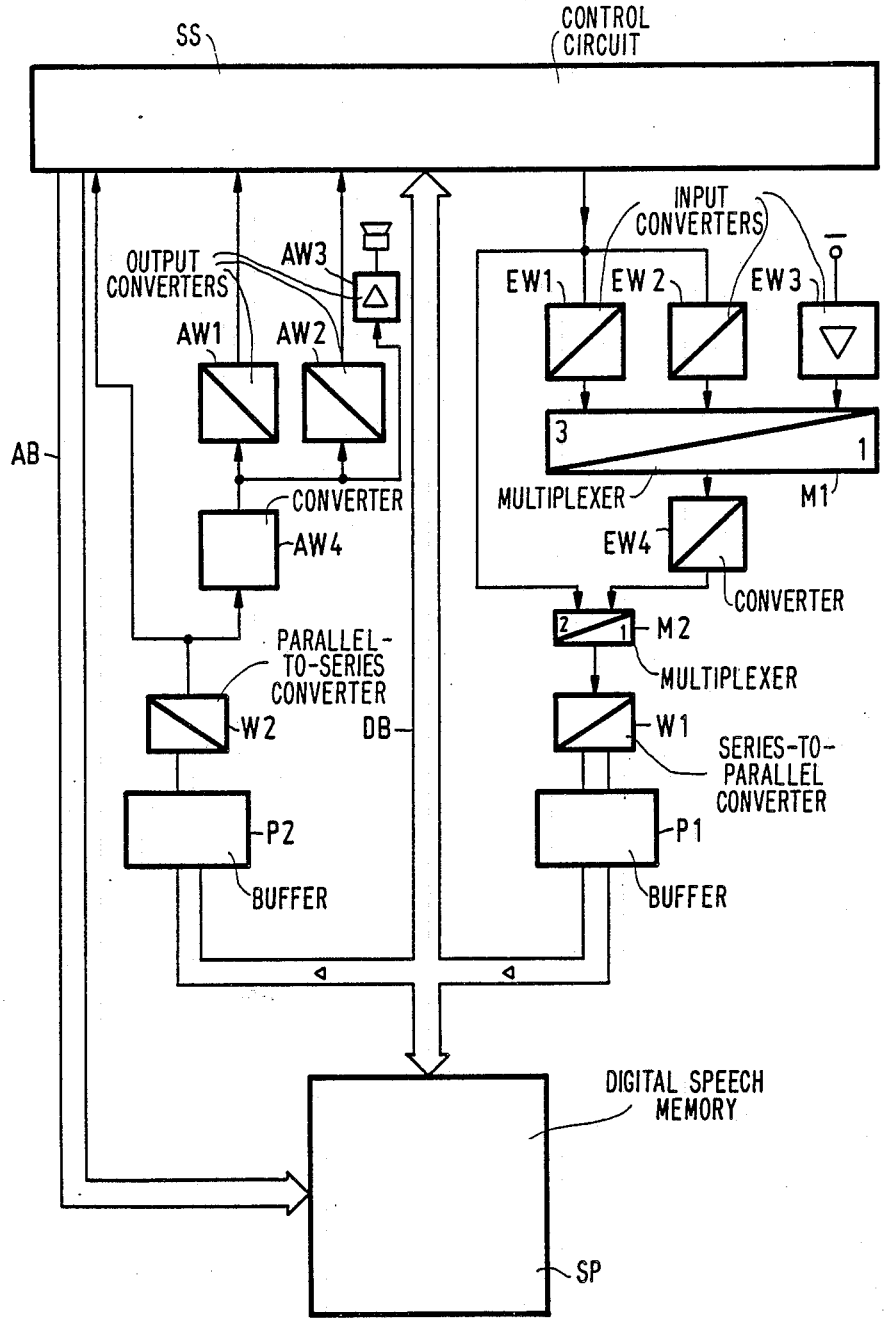
SS
CONTROL CIRCUIT
INPUT CONVERTERS
OUTPUT CONVERTERS
AW3
AW1
AW2
EW1
EW2
EW3
AB
CONVERTER
AW4
3
1
MULTIPLEXER
M1
EW4
CONVERTER
2
1
M2
MULTIPLEXER
PARALLEL-TO-SERIES CONVERTER
W2
DB
W1
SERIES-TO-PARALLEL CONVERTER
P2
P1
BUFFER
BUFFER
DIGITAL SPEECH MEMORY
SP

CIRCUIT FOR STORING A SPEECH SIGNAL IN A DIGITAL SPEECH MEMORY

BACKGROUND OF THE INVENTION

The invention relates to a circuit for storing a speech signal in a digital speech memory and for reproducing the stored speech signal, comprising a control curcuit which produces the control commands and clock signals for the individual modules of the circuit, the speech signal being available in one of various predetermined codes.

Such circuit can, for example, be used for automatic announcements in digital communication networks, in which the communication traffic can take place in various predetermined codes. For each of these codes a separate highway or circuit is provided in such a network. A description of such a network can, for example, be found in an article by W. Böhm and M. Maisel (Böhm, W. and Maisel, M.: PKI Technische Mitteilungen 1/85, pp. 18 to 26, Philips Kommunikations Industrie AG, Turn-und-Taxis-Str. 10, D8500 Nünberg).

German Patent Application No. DE 29 50 066 A1 discloses a method of storing and reproducing an analog signal which, however, is not suitable as a basis for automatic announcing means for one of the above communication networks.

SUMMARY OF THE INVENTION

It is an object of the invention to provide a circuit of the type mentioned in the opening paragraph, which is suitable as an announcing means for one of the aforementioned networks and in whose digital speech memory communications of considerable lengths can be stored.

This object is achieved by means of:

1.1 a preferred digital code, in which the speech signal is read into the digital speech memory, 1.2 input converters, converting the speech signal to be stored from an available code into the preferred digital code if it is not already present in this code, 1.3 a multiplexer means through which, controlled by the control circuit, the converted speech signal is conveyed to the input of the digital speech memory, 1.4 output converters, converting the speech signal read from the digital speech memory into each of the predetermined codes.

Texts of announcements of considerable lengths can therefore, according to the invention, be stored in the digital speech memory, because storing will take place in a preferred code. A code, which is particularly suitable for the compressed storage of digital speech signals, is selected to be the preferred code (cf. the aforementioned application DE No. 29 50 066 A1).

The insertion of buffer stores relieves the control circuit. It needs to be activated only when the buffer stores have reached a specific degree of filling. The code conversion can be provided in a cost-effective way if commercial digital-to-analog or analog-to-digital converters are employed, which are available for all current digital codes and are distinguised by a small power dissipation and a small required space.

BRIEF DESCRIPTION OF THE DRAWING

The invention will be further explained with reference to an embodiment and a drawing Figure.

The FIGURE shows the block diagram of a circuit in accordance with the invention.

DETAILED DESCRIPTION OF THE INVENTION

According to the circuit in the Figure a control circuit SS is connected to a digital speech memory SP via a data and control bus DB. Clock lines and subordinate control lines are not represented in the Figure because the necessity thereof is evident to those skilled in the art and inserting these elements will not cause any problems. Via the same bus DB also two buffer stores P1 and P2 are connected to the control circuit SS. Via an address bus AB, addresses of the memory locations to be written or read are transmitted from the control circuit SS to the address inputs of the digital speech memory SP.

In the embodiment the digital speech memory SP is an EEPROM, the buffer stores P1 and P2 are FIFO memories and the control circuit is a constituent part of a communication network mentioned in the opening paragraph. In this communication network there are three highways or circuits, one for PCM signals, one for DCDM-16 signals and one for DCDM-32 signals (PCM: Pulse Code Modulation; DCDM-16: Digital-Controlled-Delta-Modulation with 16 kHz sampling frequency; and DCDM-32 accordingly with 32 kHz sampling frequency).

In the Figure, a further form of a speech signal is indicated, that is to say, the acoustic form. For the systematic discussion, also this form of the speech signal is to be understood as a code in the present case. In this sense, a microphone with an amplifier constitutes an input converter EW3, converting acoustic signals into analog (electric) signals, and an amplifier with a loudspeaker constitutes an output converter AW3, converting analog (electric) signals into acoustic signals. A further input converter EW1 converts DCDM-32 signals into analog signals, whereas a converter EW2 converts PCM signals into analog signals. The inputs of the converters EW1 and EW2 are connected to a signal output of the control circuit SS.

The outputs of the three input converters EW1, EW2 and EW3 are connected to the inputs of a multiplexer M1. The multiplexer M1 is controlled by the control circuit SS in a manner such that the encoded speech signal, now available in analog form, of the subscriber who wishes to store a text of an announcement, is switched through to the output of the multiplexer M1, if the subscriber's signal is among the output signals of the three input converters.

The output signal of the multiplexer M1 is now converted by a fourth input converter EW4 from the analog form into a DCDM-16 signal. The DCDM-16 code is the preferred digital code in which a speech signal is written into the digital speech memory SP; this code is also one of the codes that can be seleected by a subscriber of the transmission system for transmitting his signal. For this purpose, the above signal output of the control circuit SS as well as the output of the converter EW4 are connected to a second multiplexer M2, and again the control circuit SS controls the multiplexer M2 in a manner such that the desired signal is available at the multiplexer output. The DCDM-16 signal is now applied to a FIFO memory P1 (FIRST IN FIRST OUT) via a series-to-parallel converter W1 and from this FIFO memory P1, likewise controlled by the control circuit SS, written into the digital speech memory SP.

When texts of announcements are read out from the digital speech memory SP, the signal is first buffered in a second FIFO memory P2 and then passed through a parallel-to-series converter W2. Then it is applied—in the DCDM-16 code—to a signal input of the control circuit SS and also to the input of an output converter AW4, which converts the DCDM-16 signal into an analog signal. The output of the converter AW4 is connected to the inputs of three further converters that is to say, the aforementioned elecroacoustic converter AW3, a converter AW2 which converts its analog input signal into a PCM signal, and a converter AW1 which converts its analog input signal into a DCDM-32 signal. The outputs of the two converters AW1 and AW2 are connected to two further signal inputs of the control circuit SS.

Thus, with the aid of the control circuit SS, it is possible that each subscriber, irrespective of the code of his speech signals, can always become acquainted with the text of the announcement which is stored in the digital speech memory SP.

We claim:

1. A circuit, for storing a speech in a digital speech memory and for reproducing the stored speech signal, comprising:

input converting means for converting an input speech signal encoded in any one of a plurality of different codes into a preferred digital code format;

a digital memory for storing the converted encoded speech signal in the preferred digital code format;

output converting means for converting the stored speech signal into a plurality of speech output signals each encoded in a respective one of the plurality of different codes; and means for writing the coded speech signal encoded in the preferred digital code into said digitral memory and for reading out the stored speech signal from said digital memory and applying it to said output converting means.

2. A circuit according to claim 1, wherein said input converting means comprises a plurality of input converters for receiving encoded speech signals each encoded in one of the plurality of different codes and for converting the encoded speech signals into analog speech signals;

a multiplexer receptive of the analog speech signals from said plurality of input converters for selecting among them; and a converter for converting the analog speech signal selected by said multiplexer into a speech signal encoded in the preferred digital code.

3. A circuit according to claim 2 further comprising a second multiplexer for selecting between the output of said converter for converting into a speech signal encoded in the preferred digital code and an input signal already encoded in the preferred digital code.

4. A circuit according to claim 2 further comprising a first buffer memory for buffering the input to said digital memory; and a second buffer memory for buffering the output of said digital memory.

5. A circuit according to claim 1 further comprising a first buffer memory for buffering the input to said digital memory; and a second buffer memory for buffering the output of said digital memory.

6. A circuit according to claim 1, wherein said output converting means comprises a converter for converting an encoded speech signal read out from said digital memory into an analog speech signal; and a plurality of output converters each receiving the analog speech signal and each converting the analog speech signal to a speech signal encoded in a respective one of the plurality of codes for producing simultaneous speech signals encoded in different codes.

7. A circuit according to claim 6 further comprising a first buffer memory for buffering the input to said digital memory; and a second buffer memory for buffering the output of said digital memory.

* * * * *